US006676061B1

(12) United States Patent
Cain

(10) Patent No.: US 6,676,061 B1
(45) Date of Patent: Jan. 13, 2004

(54) ROPE RETAINER AND METHOD

(76) Inventor: Jeffrey R. Cain, 5959 Hwy. 22/42, Ramseur, NC (US) 27316

( * ) Notice: Subject to any disclaimer, the term of this patent is extended or adjusted under 35 U.S.C. 154(b) by 23 days.

(21) Appl. No.: 10/055,226

(22) Filed: Jan. 23, 2002

(51) Int. Cl.[7] ..... B65H 75/18; B65H 75/22; B65H 75/28

(52) U.S. Cl. ..... 242/401; 242/402; 242/405.1; 242/407.1; 242/571

(58) Field of Search ..... 242/401, 402, 242/405.1, 405.2, 407.1, 129, 125.1, 125.2, 574, 574.1, 574.2, 577, 571, 577.2

(56) References Cited

U.S. PATENT DOCUMENTS

| | | | | | |
|---|---|---|---|---|---|
| 325,394 | A | * | 9/1885 | Cavalli | 242/577.2 |
| 2,057,728 | A | * | 10/1936 | Lester | 242/577.2 |
| 2,261,943 | A | * | 11/1941 | Rogers | 242/577.2 |
| 2,555,851 | A | * | 6/1951 | Hancock | 242/577.2 |
| 4,437,625 | A | * | 3/1984 | VanSickle | 242/129 |
| 4,616,790 | A | * | 10/1986 | Beltran | 242/129 |
| 4,846,343 | A | * | 7/1989 | Rupert | 242/129 |
| 6,164,582 | A | * | 12/2000 | Vara | 242/405.2 |
| 2001/0008260 | A1 | * | 7/2001 | Messier | 242/129 |

* cited by examiner

*Primary Examiner*—John M. Jillions

(57) ABSTRACT

A rope retainer and method are disclosed which provides convenience to rodeo contestants and others that need to quickly and easily select a particular rope. The rope retainer holds a rope coil and allows the end of the rope containing information to be separated and apart from the displayed rope coil so that the information can be easily read.

14 Claims, 6 Drawing Sheets

ROPE RETAINER AND METHOD

FIELD OF THE INVENTION

The invention herein pertains to retainers for coiled ropes and particularly pertains to retainers for ropes used in rodeos which have identification data on the end thereof.

DESCRIPTION OF THE PRIOR ART AND OBJECTIVES OF THE INVENTION

Ropes that are used for lassoing steers, calves, horses and the like during rodeo performances come with various numbers of strands, lengths, diameters and hands. Cowboys develop a "feel" for a rope for a particular event and are therefore confident and comfortable when using the rope of their choosing. During rodeo performances contestants must often quickly select a rope for use in an upcoming event and the wrong choice may cost the contestant a large amount of prize money. Rodeo contestants generally have available several ropes of different sizes, hands, lengths, strands and colors. These ropes are usually carried loose in a travel bag or otherwise and generally have an identification tag or label at one end which specifies important data (length, diameter, hand and the like) for easy selection. However, when a rope is transported to a rodeo in a coiled fashion, it can easily become entangled with other ropes or become uncoiled and the identification data of a particular rope can be difficult to quickly read or can be misread during the haste to select a rope for performance purposes.

Thus, with the problems and inconveniences of prior rope storage, transportation and selection, it is an objective of the present invention to provide a rope retainer which will allow storage of a coiled rope in a stable, convenient manner.

It is still another objective of the present invention to provide a rope retainer which will allow a user to easily read the identification data on the end of the rope.

It is yet another objective of the present invention to provide a rope retainer which includes a display catch for holding the end of the rope in a secure manner.

It is another objective of the present invention to provide, in one embodiment a fixed, circular rope retainer which is easy to use and transport.

It is a further objective of the present invention to provide an alternate embodiment of the rope retainer which can be collapsed for easy storage when not in use.

Various other objectives and advantages of the present invention will become apparent to those skilled in the art as a more detailed description is set forth below.

SUMMARY OF THE INVENTION

The aforesaid and other objectives are realized by a rope retainer and method of use whereby a coiled rope can be stored on a retainer made from a suitable, durable material such as a rigid plastic which, in the preferred embodiment is formed having a circular frame with a series of brackets positioned along the outer edge. A display catch is positioned on a support attached to the frame for maintaining the end of the rope which contains information.

In an alternate embodiment of the invention a frame is formed by two pivotable, elongated members which can be secured in an open posture by a threaded member and a wingnut. The frame can be collapsed by loosening the wingnut and pivoting the pair of elongated members to a closed position for easy transportation and storage when not containing a rope.

DETAILED DESCRIPTION OF THE PREFERRED EMBODIMENTS AND OPERATION OF THE INVENTION

Figure 1:
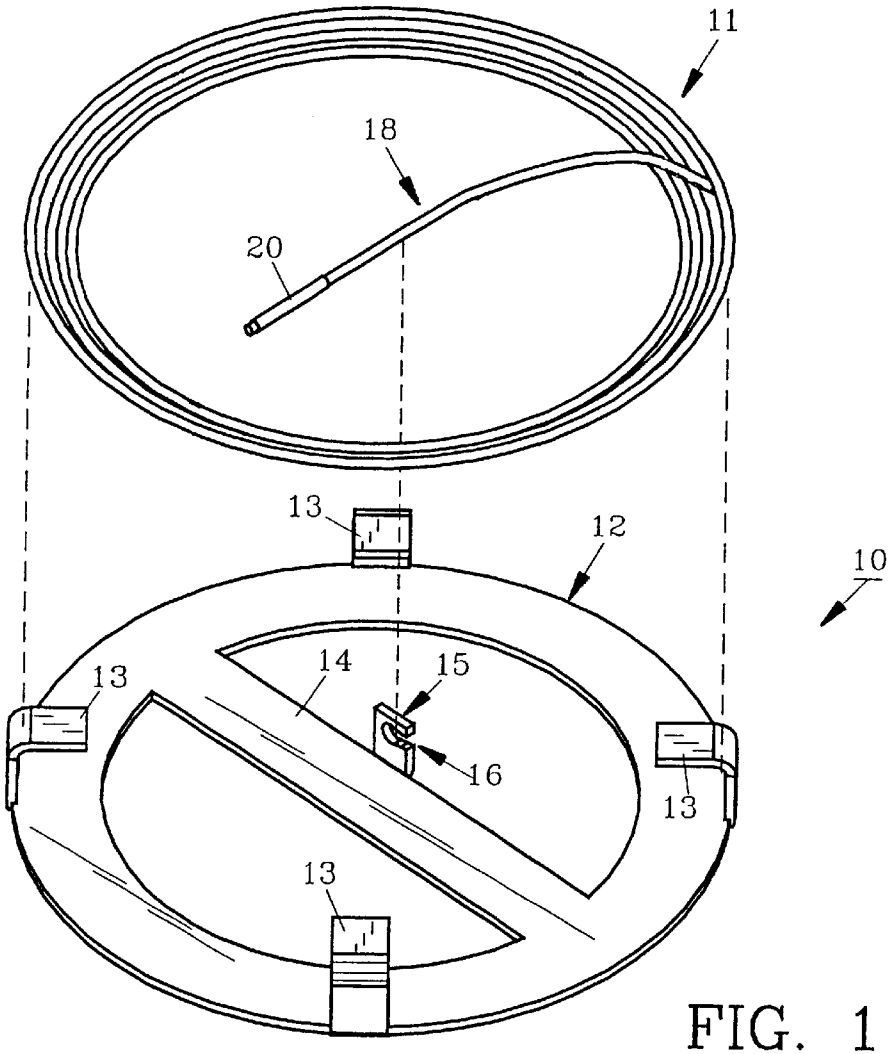
FIG. 1 shows the preferred embodiment of the rope retainer with a coiled rope exploded therefrom.
Figure 4:
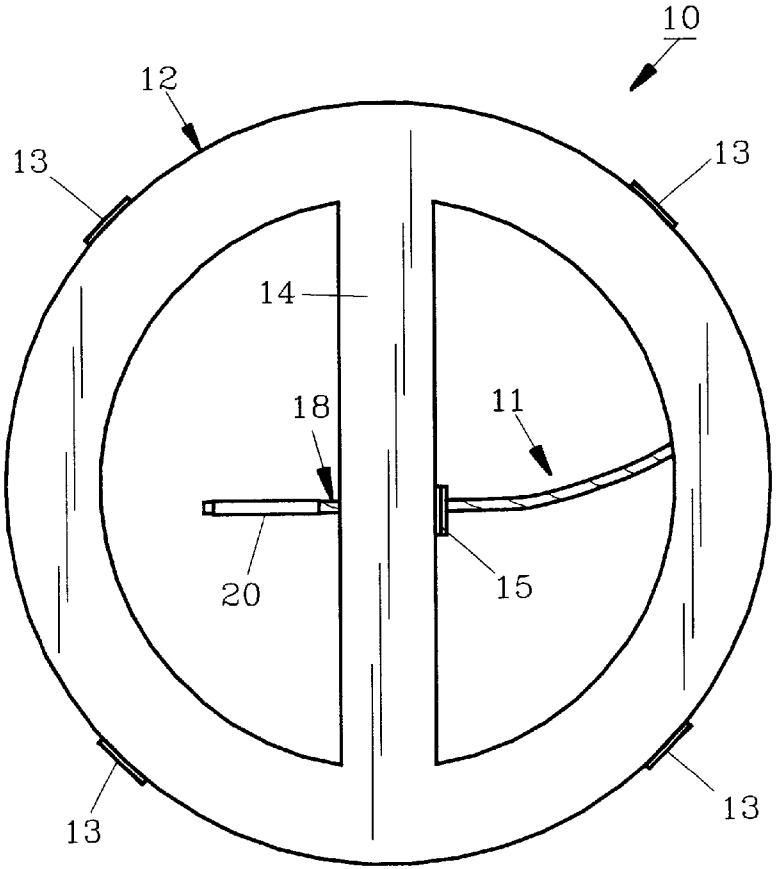
FIG. 4 features a bottom view of the rope retainer of FIG. 1 with one end of the rope exposed.
Figure 2:
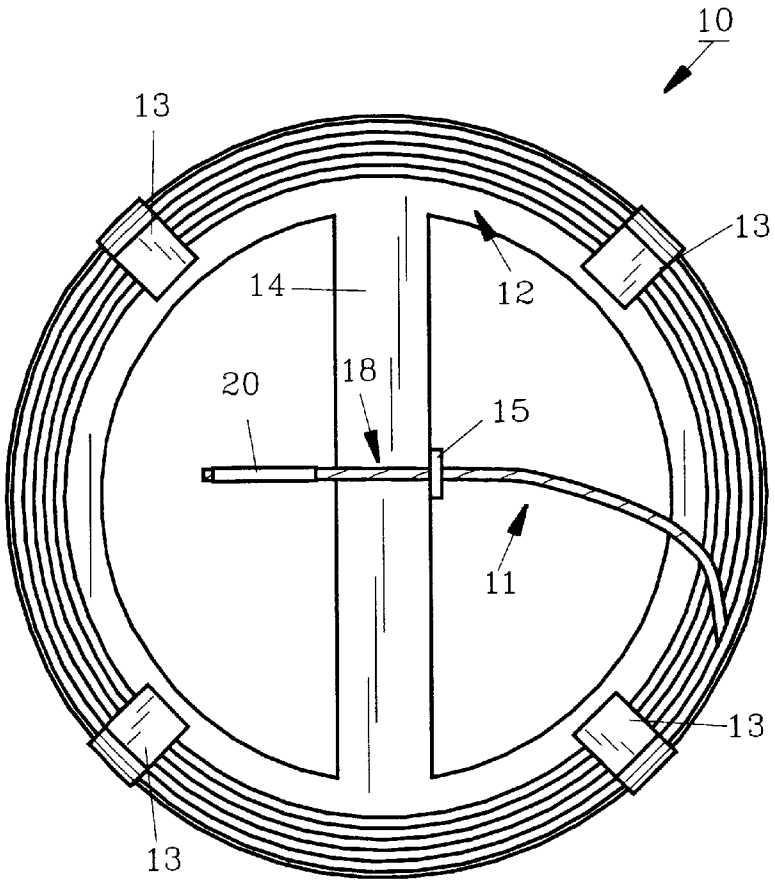
FIG. 2 illustrates the rope retainer of FIG. 1 with the rope coil contained therein.
Figure 3:
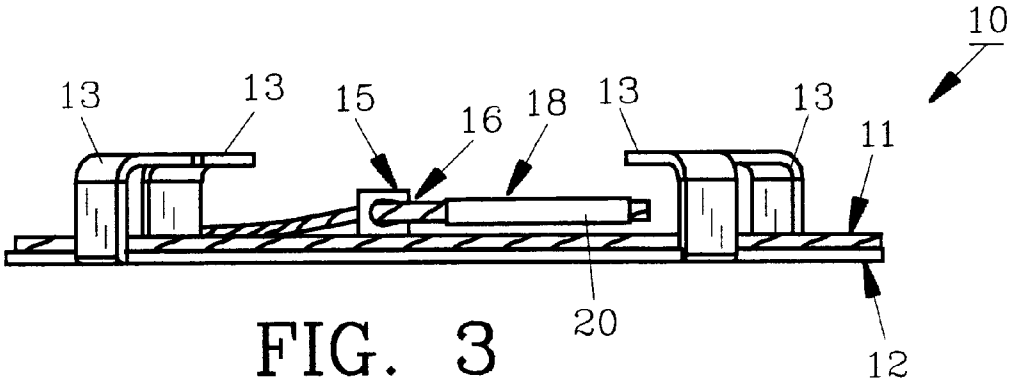
FIG. 3 demonstrates a side schematic view of the rope retainer as seen in FIG. 1 but with only a partial rope coil.

For a better understanding of the invention and its operation, turning now to the drawings, FIGS. 1–4 demonstrate preferred rope retainer 10 having coiled rodeo rope 11 exploded therefrom. Rope retainer 10 has a planar circular frame 12 with a series of L-shaped brackets 13 attached to the outer edge as shown in FIG. 3. Rope retainer 10 may be formed of metal but preferably is formed of a hard, durable plastic and manufactured by conventional plastic molding techniques.

Figure 5:
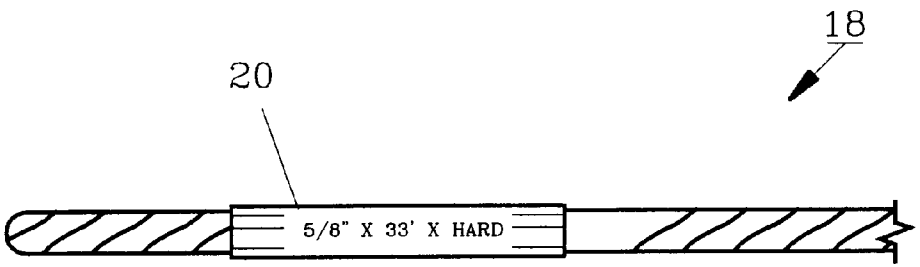
FIG. 5 pictures the end of the rope as seen in FIG. 2 enlarged to display the information thereon.

In FIG. 2 rope 11 is shown stored on rope retainer 10 whereby L-shaped brackets 13 assist in holding rope 11 on rigid frame 12. Support 14 spans the opening of circular frame 12 with display catch 15 affixed thereto. Display catch 15 provides notch 16 as shown in FIGS. 1 and 3 which frictionally grips end 18 of rope 11 as shown in FIG. 2 and enlarged in FIG. 5. Standard end 18 of rope 11 provides information as seen fragmented and enlarged in FIG. 5. Conventional identification tag 20 on rope end 18 illustrates that rope 11 has a diameter of ⅝", a length of 33' and has a "hard" hand. As shown in FIGS. 2 and 3, tag 20 provides necessary information about rope 11 in an easy to read, convenient position. In FIG. 3 rope 11 is shown with only one coil for clarity of gripping by display catch 15.

Figure 7:
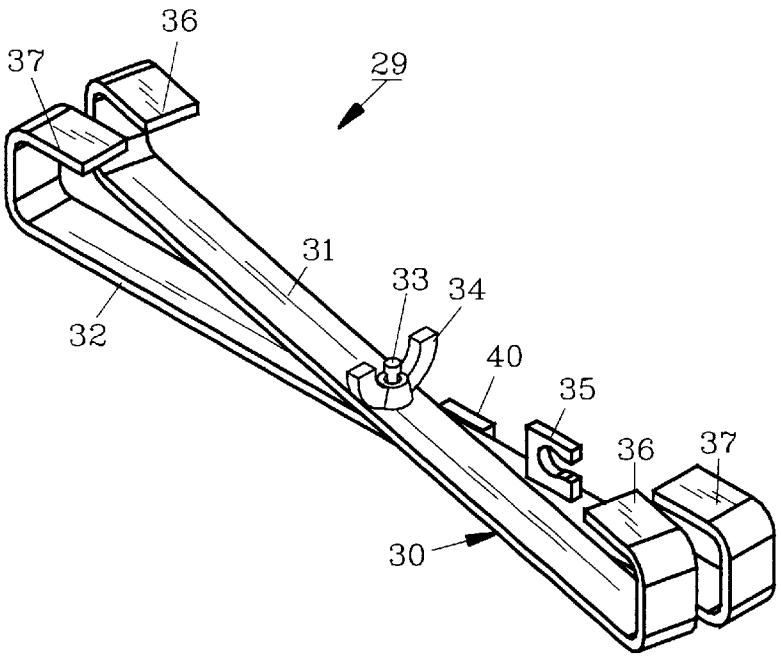
FIG. 7 shows the rope retainer of FIG. 6 in a closed posture.
Figure 6:
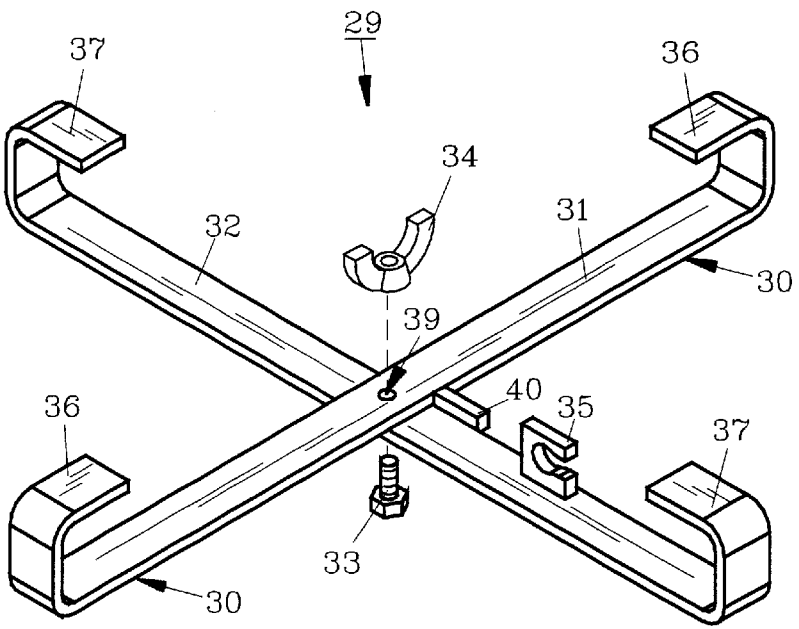
FIG. 6 depicts an alternate embodiment of a rope hanger without a rope and with a threaded member and wingnut exploded therefrom.
Figure 8:
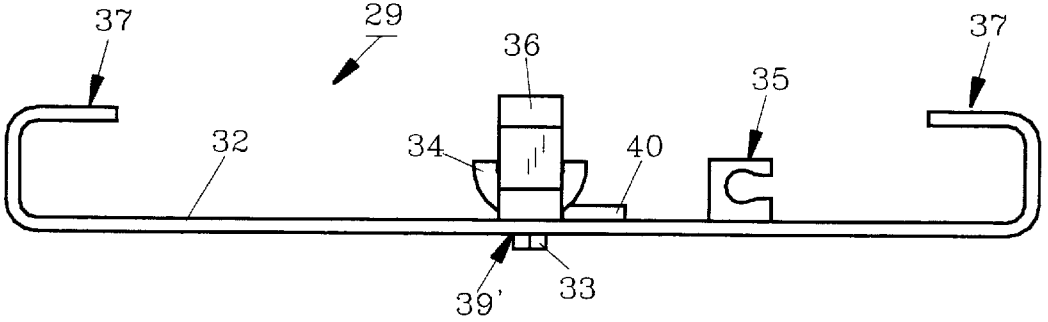
FIG. 8 demonstrates a side view of the rope retainer as seen in FIG. 6.
Figure 9:
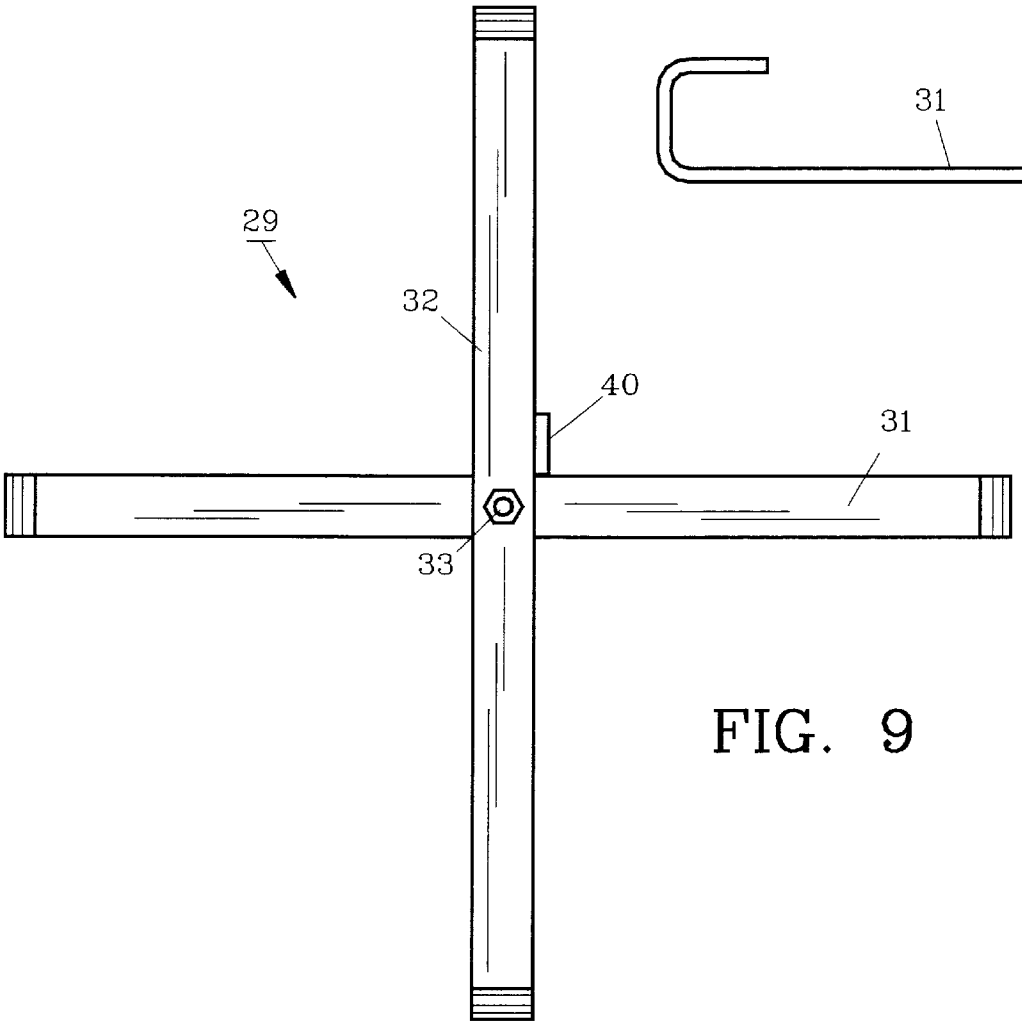
FIG. 9 pictures a bottom view of the rope retainer of FIG. 6.

In an alternate embodiment of the invention as shown in FIG. 6, rope retainer 29 is shown. Rope retainer 29 includes collapsible frame 30 formed of two elongated members: 31, 32 which are pivotally attached at their longitudinal midpoints and can be opened as shown in FIGS. 6, 8, 9, 10 and 11 for use or closed as shown in FIG. 7 for storage purposes without a coiled rope thereon. Stop member 40 which is attached to elongated member 32 terminates the pivoting motion of elongated member 31 as seen in FIGS. 6 and 9. Apertures 39, 39' (FIGS. 6 and 8) at respectively the longitudinal midpoint of elongated members 31, 32 provide openings for threaded member 33. Similar to preferred rope retainer 10, rope retainer 29 has display catch 35 attached to elongated member 32 which is likewise notched to maintain end 18 of rope 11 in a easy, visible posture as explained for rope retainer 10. In FIG. 7, rope 11 has been removed and threaded member 33 (seen exploded therefrom in FIG. 6) has been loosened in wingnut 34 to allow elongated member 31 to rotate into a near parallel relation with elongated member 32.

As further shown in FIG. 6, elongated members 31, 32 each have L-shaped brackets 36, 37 respectively, mounted on each terminal end thereof. L-shaped brackets 36, 37 maintain coiled rope 11 on rope retainer 29 while in use.

The preferred method of containing rope 11 uses rope retainer 10 as shown herein and includes the step of manually coiling selected rope 11 to a diameter slightly less than the diameter of rope retainer 10 shown in FIG. 1. Next, coiled rope 11 is then placed on frame 12 and is urged under L-shaped brackets 13. The identification end 18 of rope 11 is then separated from coiled rope 11 and positioned in notch 16 of display catch 15 with label 20 visible. Tag 20 can then be easily read and rope 11 can then be selected and removed from retainer 10 as needed.

Figure 11:
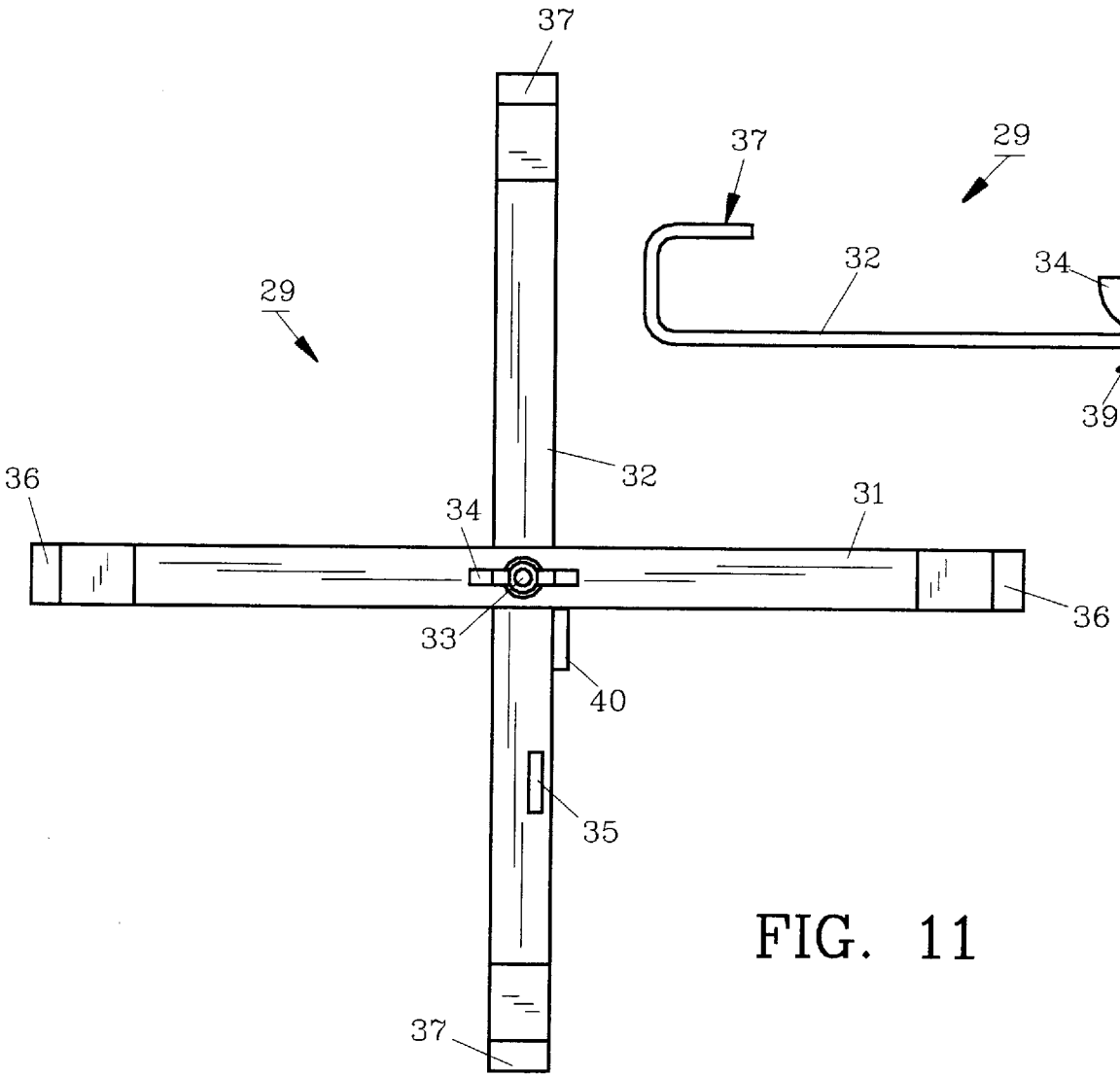
FIG. 11 shows a top view of the rope retainer as seen in FIG. 8.
Figure 10:
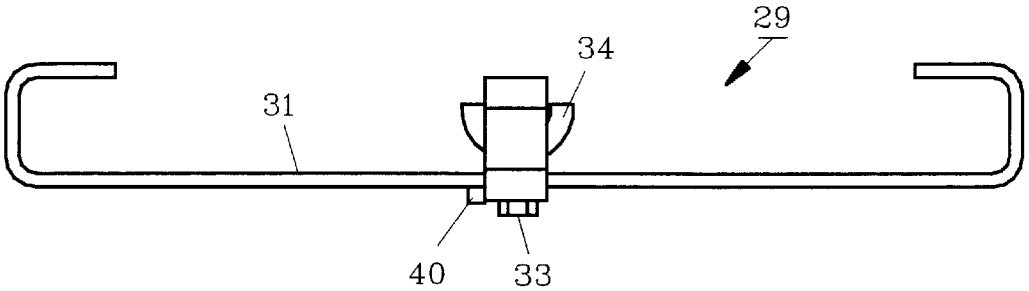
FIG. 10 illustrates a side view of the rope retainer of FIG. 6 with the wingnut and threaded member attached.

In the alternate use of retaining a rope on rope retainer 29, the steps include pivoting elongated members 31, 32 to a fully opened posture as shown in FIGS. 6, 9 and 11 with stop member 40 contacted by elongated member 31. Next, threaded member 33 which has been loosened to allow pivoting is tightened by manually rotating wingnut 34 in a clockwise direction. Thereafter, rope 11 which has been manually coiled is then placed on frame 30 within L-shaped brackets 36, 37 and end 18 of rope 11 is then separated and positioned within display catch 35 which frictionally engages end 18 of rope 11 in a slot for easy viewing. When rope 11 is removed from retainer 29, wingnut 34 can be loosened, elongated members 31, 32 pivoted to a near parallel relation as shown in FIG. 7 and thereafter wingnut 34 can be retightened so rope retainer 29 can be stored in its collapsed posture.

The illustrations and examples provided herein are for explanatory purposes and are not intended to limit the scope of the appended claims.

I claim:

1. A rope retainer comprising: a frame, a bracket, said bracket attached to said frame along its outer edge, a catch, said catch defining an open-ended slot, said catch positioned inside said frame whereby a rope can be held in a coiled posture along said frame by said bracket with one end of the rope gripped by said catch inside the rose coil.

2. The rope retainer as claimed in claim 1 wherein said frame is circular.

3. The rope retainer as claimed in claim 1 wherein said bracket is L-shaped.

4. The rope retainer as claimed in claim 1 formed from plastic.

5. The rope retainer as claimed in claim 1 formed from metal.

6. The rope retainer as claimed in claim 1 further comprising an additional plurality of brackets, each of said additional brackets attached to said frame along its outer edge.

7. A pivotable rope retainer comprising: a pair of elongated members, said elongated members pivotally attached at the respective midpoints of each, a plurality of brackets, said brackets mounted on each of the terminal ends of said elongated members, whereby said elongated members can be pivoted to an open posture for containing a coiled rope or to a closed posture for storage of the retainer, a display catch, said display catch mounted on one of said elongated members, said catch defining an open-ended slot whereby an end of the rope can be gripped within said slot inside the rope coil.

8. The rope retainer as claimed in claim 7 formed from plastic.

9. The rope retainer as claimed in claim 7 formed from metal.

10. The rope retainer as claimed in claim 7 further comprising a stop, said stop attached to one of said elongated members.

11. The method of containing a rope on a retainer having a catch with an open-ended slot, to hold the rope while displaying information on one end of the rope, said method comprising the steps of:

a) coiling the rope to a size less than the overall size of the retainer;

b) placing the coiled rope on the retainer; and c) placing the end of the rope with information thereon in the display catch a slot inside the coil of rope.

12. The method of claim 11 further comprising the step of removing the rope from the rope retainer.

13. The method of claim 11 wherein coiling the rope comprises the step of manually coiling the rope into a circle.

14. The method of claim 11 wherein placing the rope on the retainer comprises the step of placing the rope on the retainer and thereafter placing the end of the rope in the catch slot.

* * * * *